United States Patent [19]

Schorsch et al.

[11] 4,033,142

[45] * July 5, 1977

[54] APPARATUS FOR REFRIGERATING MATERIALS

[75] Inventors: John B. Schorsch, Rydal; William E. Graul, Drexel Hill, both of Pa.; David Barash, Ridgefield, Conn.

[73] Assignee: Union Corporation, Verona, Pa.

[ * ] Notice: The portion of the term of this patent subsequent to Sept. 23, 1992, has been disclaimed.

[22] Filed: June 17, 1975

[21] Appl. No.: 587,546

Related U.S. Application Data

[63] Continuation of Ser. No. 365,117, May 30, 1973, Pat. No. 3,906,743.

[52] U.S. Cl. ..... 62/381; 241/23

[51] Int. Cl.[2] ..... F25D 25/02

[58] Field of Search ..... 62/63, 374, 381; 241/17, 23

[56] References Cited

UNITED STATES PATENTS

| | | | |
|---|---|---|---|
| 2,879,005 | 3/1959 | Jarvis | 241/17 |
| 3,015,219 | 1/1962 | Veyrie | 62/381 |
| 3,213,634 | 10/1965 | Granata | 62/63 |
| 3,395,549 | 8/1968 | Grimes | 62/63 |
| 3,666,185 | 5/1972 | Williams | 241/17 |

*Primary Examiner*—Ronald C. Capossela

*Attorney, Agent, or Firm*—Benasutti Associates, Ltd.

[57] ABSTRACT

Material is fed into a revolving drum which has an interior configuration, preferably in the form of a helical blade, to convey the material at a controlled rate through the drum. A low temperature gas, such as nitrogen, is introduced into the drum downstream when viewed in the direction of travel of the material, in a liquid state at a controlled rate through a spray nozzle system, thereby continuously exposing the material to the cooling effect of the gas. A portion of the gas is recirculated from the upstream end to the downstream end of the drum. The material is pre-cooled in the upstream portion of the drum. After exiting from the drum, the material may be crushed or impacted and separated.

16 Claims, 7 Drawing Figures

APPARATUS FOR REFRIGERATING MATERIALS

This is a continuation application Ser. No. 365,117 filed May 30, 1973 Now U.S. Pat. No. 3,906,743.

BACKGROUND OF THE INVENTION

This invention relates generally to continuous cryogenic treatment of materials. More particularly, the invention relates to an apparatus and process for continuously feeding material, such as scrap, through a freezing zone to render it brittle so that, thereafter, it can be crushed or impacted and separated according to the various types of material of which is it composed.

In the prior art, it is known to subject material, such as insulated wire, to a low temperature gas, such as nitrogen, in a liquid atomized state, so that the insulation becomes brittle and can be cracked off of the metallic wire, thereby separating the wire from the insulation. See, for example, U.S. Pat. No. 3,647,149. One disadvantage of the prior art devices, such as that shown in the referenced patent, wherein a conveyor belt is used in the freezing zone, is that it is difficult to lubricate the moving parts of the apparatus within the extremely cold environment. Also, there can be a frost build-up within the device and the accumulation of fine particles or other undesirable material.

Other problems that have arisen in prior art devices involve the distribution and agitation of the gas within the freezing chamber and, in particular, involve attempts to get maximum exposure of the product to the cooled gas and maximum utilization of the cooling effect of the gas.

SUMMARY OF THE INVENTION

In accordance with the preferred embodiment of this invention, we have provided a rotating drum having transport means, most preferably helices attached to the inner surface of the drum for moving the material from an input end through a precooling zone and downstream freezing zone and then discharging it. The rate of feed is adjustably controlled by regulating the speed at which the drum rotates. In connection with this apparatus, we have provided a cold gas circulating system having a plurality of nozzles for introducing liquified refrigerant gas into the interior of the drum at spaced intervals. The nozzles are supported in a unique manner. Some of the used nitrogen gas is drawn off at the upstream end of the drum and re-introduced at the downstream end of the drum. Part of the used gas that has lost its effectiveness is continuously exhausted.

Various other inventive structural and process features will become apparent from the following description with reference to the accompanying drawings.

The primary object of this invention is to provide an improved apparatus and method for cryogenic processing of material. This and other objects of the invention will also become apparent from the following description.

DESCRIPTION OF THE PREFERRED EMBODIMENT

Figure 1:
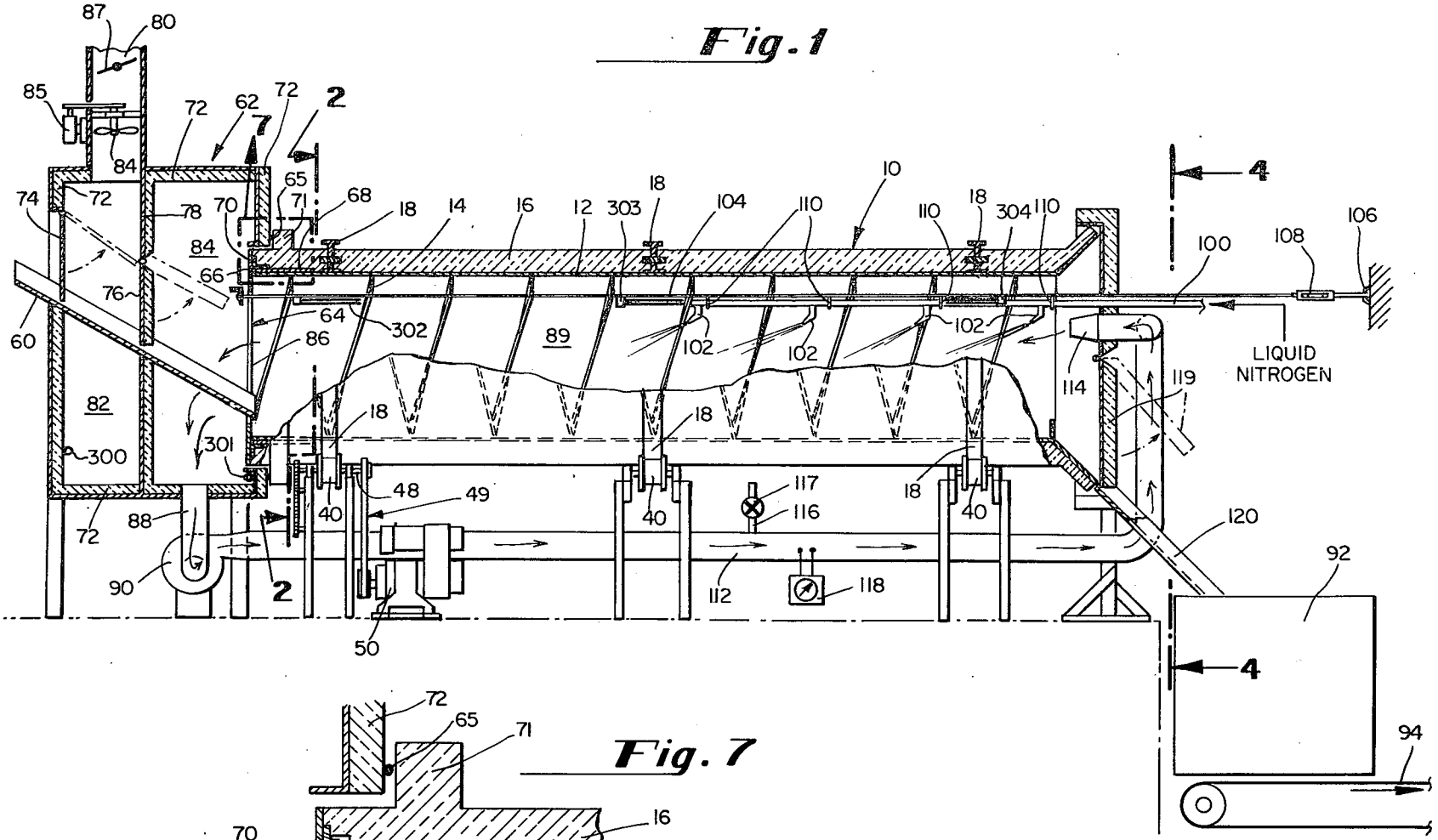
FIG. 1 is a side view of an apparatus in accordance with our invention partially broken away and shown in section with alternate positions shown in phantom lines and certain portions shown schematically.
Figure 7:
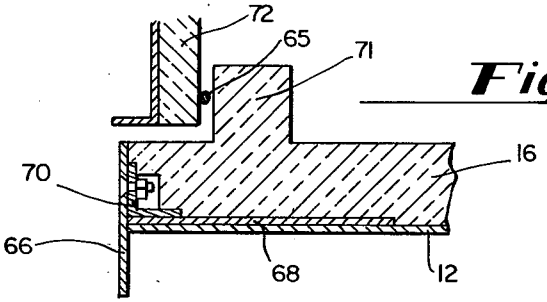
FIG. 7 is an enlarged section of a portion of the device shown in FIG. 1.

Although specific forms of the invention have been selected for illustration in the drawings, and the following description is drawn in specific terms for the purpose of describing these forms of the invention, this description is not intended to limit the scope of the invention which is defined in the appended claims.

In FIG. 1 a drum, designated generally 10, comprises a cylindrical shell 12 made of a suitable material for withstanding extremely cold temperatures, such as 304 stainless steel or other similar cryogenic material. The interior of the drum in accordance with our invention is provided with a means for transporting material through the drum upon rotation of the drum. In the preferred embodiment shown, the interior configuration of the drum comprises a flat spiral blade 14 disposed in a helix welded along the inner surface of the drum. The blade extends radially inwardly from the wall of the drum a distance of approximately one-tenth of the diameter of the drum.

Figure 2:
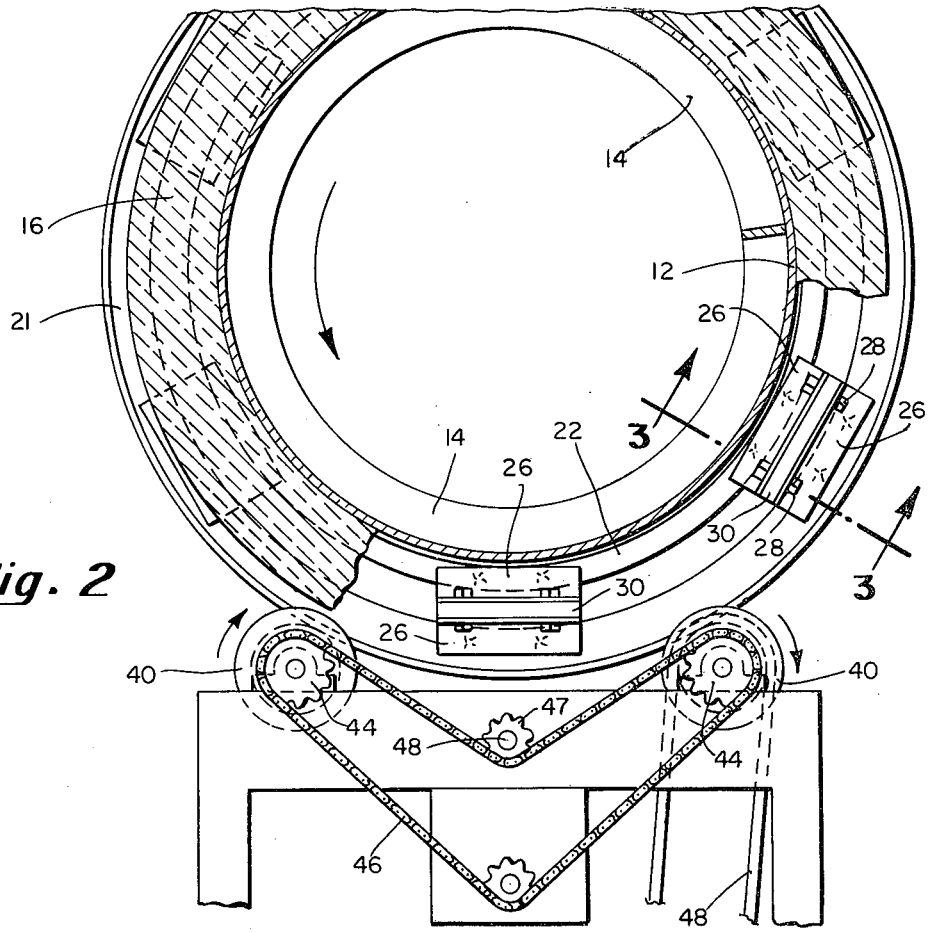
FIG. 2 is an enlarged section taken as indicated by the lines and arrows 2—2 in FIG. 1, which has been foreshortened and partially broken away.
Figure 4:
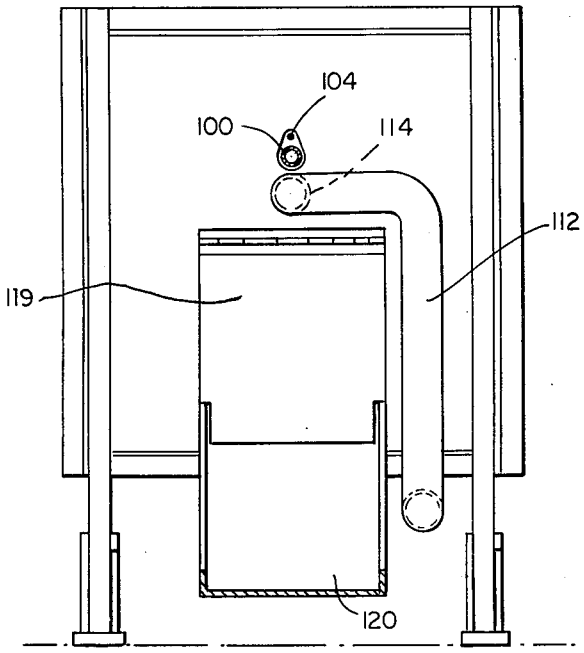
FIG. 4 is an enlarged end view taken as indicated by the lines and arrows 4—4 in FIG. 1.
Figure 3:
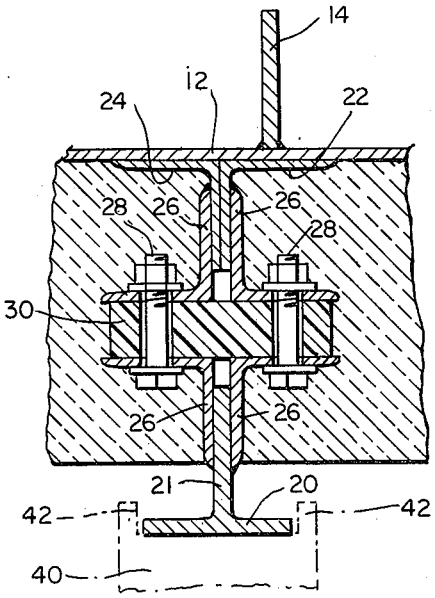
FIG. 3 is a greatly enlarged section taken as indicated by the lines and arrows 3—3 in FIG. 2.

The drum is supported for rotation on a plurality of rings 18 which provide a force transmitting, insulating means. The rings are of a unique construction in that they comprise two T-shaped members insulated from one another by a spacer made of plastic or other suitable insulating and force-transmitting material. A cross-section of a typical ring is shown in FIG. 3. The outer T-shaped portion 20 is a metallic ring while the inner T-shaped portion is made up of a plurality of L-shaped pieces 22 and 24 formed into an annular ring. The stems of the T-shaped portions are opposed and are joined by four brackets 26 L-shaped in cross-section and a plastic spacer 30. Referring to FIGS. 2 and 3, each of the brackets 26 are welded to their respective stems of the T-shaped portions. Bolts 28 firmly clamp the plastic spacer 30 between the brackets 26.

The outside of the cylinder is covered with an insulating material 16, which extends outwardly from the shell 12 past the inner free end of the stem 20 and engaging and covering the inner portion of the rings, but not beyond the outer face of the ring 20. Thus, the insulating does not interfere with the rollers 40 which have flanges 42 embracing the cross portion of the T-shaped ring 20, so that the ring tracks in and rolls on the roller 40. The rollers 40 are driven by means of sprockets 44 mounted on common shafts with the rollers and interconnected by means of a chain 46. The sprocket 47 is mounted on a shaft 48 driven by a pulley belt drive means, designated generally 49, connected to a source of motive power 50, FIG. 1. This electric motor 50 is a variable speed motor, so that the speed at which the drum 10 rotates on the driven rollers 40 can be adjusted. Adjusting the speed of rotation adjusts the travel of material through the drum and thus regulates the exposure of the material to cold gas. Alternate means could be provided within the scope of this invention for rotating the drum on the rings, such as hydraulic motors directly driving the rollers 40.

Material enters the drum 10 by means of the input chute 60. This chute passes through a box-like entrance header, designated generally 62, at the upstream end, designated generally 64, of the drum 10. The upstream end 64 of the drum has an annular face plate 66 fixedly mounted thereto. Overlapping the shell 12 is a cylindrical reinforcing shell 68 retained by an annular flange 70. Additional insulation is provided at 71. The walls of the header 62 are insulated as shown at 72. Between the insulation 71 and the insulation on the outer wall of the header 62, there is a heat tape 65. This tape can be heated by electricity remotely controlled to prevent frost build-up in the space shown and thereby prevent wearing of the insulation. At the point at which the chute 60 enters the header 62 there is a free swinging plate 74 forming a door which automatically opens and closes as shown by the phantom and full line positions respectively in FIG. 1, when material comes down the chute and enters the header on its way toward the drum 10. An additional free swinging door is provided by the insulated plate 76 mounted on the transverse partition 78 which completely divides the box-like header into two compartments. These doors serve a useful function in connection with certain exhaust fans which will now be more fully described.

A stack 80 is provided communicating through the top of the header 62 with the upstream compartment 82. Within the stack 80 there is mounted a discharge fan 84 driven by any suitable motive means 85. The purpose of this discharge fan is to draw off air coming in with the material down the chute and also to draw off used nitrogen gas which may escape when the door 76 is opened. A control damper 87 is provided on the discharge side of the fan 84.

Figure 5:
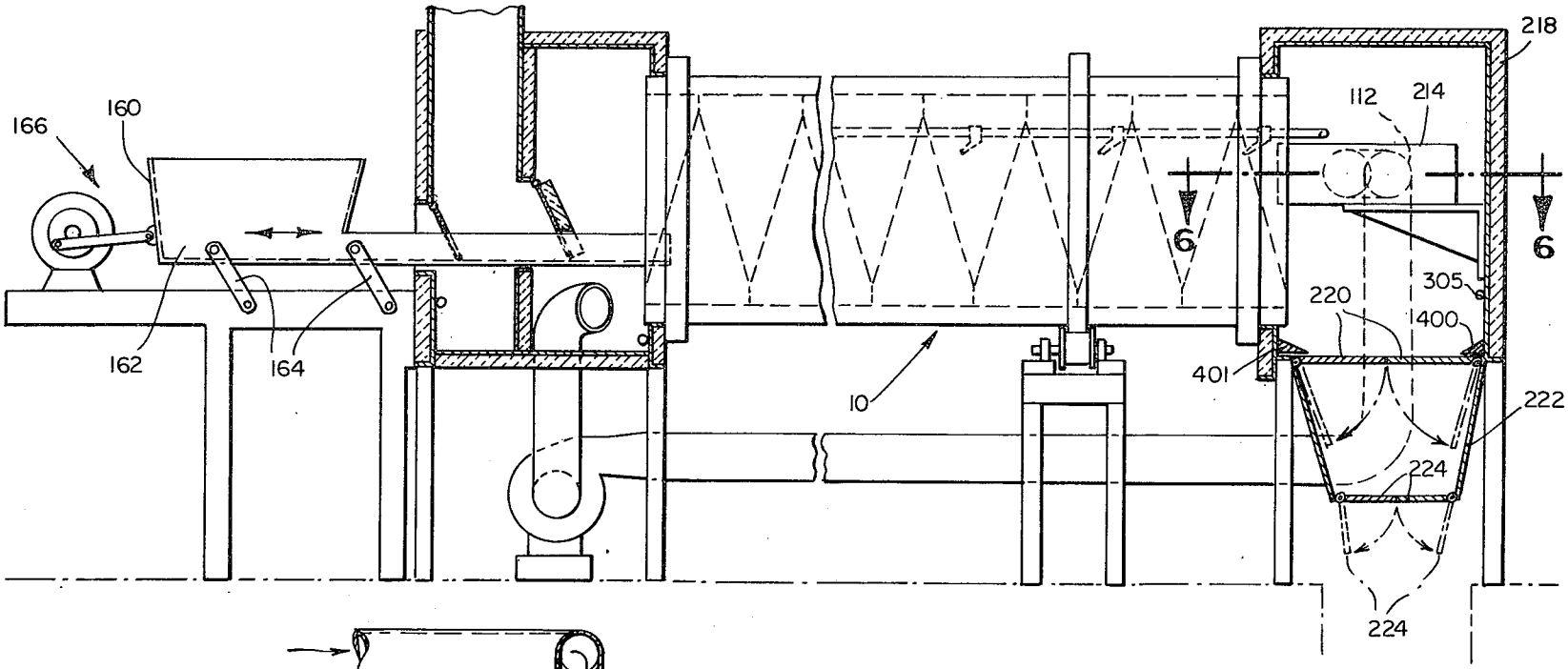
FIG. 5 is a foreshortened side view of an alternate embodiment of our invention showing the preferred embodiments of certain portions of the invention.

In the preferred construction shown in FIG. 5, the chute 60 is replaced by an alternate forced feeding means, such as a mechanical feeder 160, which reciprocates as shown by the arrows. The feeder is shown basically in a schematic form comprising a trough 162 mounted on arms 164 and driven in a reciprocating motion by means of a motor and crank arm, designated generally 166. This loosely shakes the incoming material into the rotating drum. The mechanism is not described in further detail herein since such feeders are known in the art. Indeed, a vibrating feeder could also be used as an alternate feeding means. It should be noted that the stack will continue to have a fan and a control damper for the same purposes as previously described.

While many kinds of materials can be processed by our apparatus, this invention has particular applicability to scrap metal which is composed of various components of material, such as ferrous and nonferrous metals which cannot be cleanly separated by mechanical means. By freezing the scrap material, it is possible to shatter it in a crusher or impactor and then separate out particular materials magnetically, or by other suitable means. In FIG. 1 we have shown schematically a crusher 92 and a magnetic conveyor-separator 94. These devices are not shown in greater detail, since they are well known in the art.

The first stage in the separation process is the freezing unit, and in accordance with our invention, we provide a pre-cooling chamber and a cooling chamber within our freezing unit 10. Liquid nitrogen is introduced into the freezing portion of the chamber (which is downstream when viewed in the direction of travel of the material through the chamber), through a common header 100 and a plurality of nozzles 102. As the nozzles spray the nitrogen into the chamber 14 it immediately vaporizes to low temperature gas and comes into intimate contact with the moving scrap material. As the drum rotates, the helical blade transports or advances the material down the drum. The inner surface of the shell 12 is continually moving with respect to the material, so that this surface is re-exposed to the cold gas intermittently and then comes in contact with the under surfaces of the material. This also has the effect of wiping the surface of the drum, thereby removing frost. This contact may be enhanced where flights or vanes are used, rather than a helix, by virtue of the churning action caused by the tumbling of the material as it proceeds down the inner surface of the drum. However, in this embodiment the helical blade 14 is preferable, since the continuity of the blade presents a configuration which is not susceptible to having irregular pieces of material hang-up on it. The header 100 is supported on a cable 104, which is fixedly connected at one end to and within the header 62 and is fixedly connected at the other end to any convenient structure, such as at 106. A tension device 108 is provided to adjust the tension in the cable depending on the weight of the header 100. A plurality of rings 110 are connected to the header and disposed about the cable to support the header on the cable.

The liquid nitrogen, as it enters the chamber, is at a temperature of approximately −320° F. In order to maximize the effectiveness of the nitrogen contact with the material, a flow is provided by withdrawing some of the nitrogen gas from the upstream end of the drum and pumping it back through a conduit 112 and a nozzle 114 into the downstream end of the drum 10. The nitrogen gas is heavier than air and for the most part lays in the bottom of the drum, which is mounted horizontally. The internal transport means tend to make the gas flow out the discharge end. The reverse flow condition tends to inhibit this loss. It is difficult to maintain a closed fluid flow system with so many openings at the entrance and discharge and, therefore, it is necessary to pump gas in at the discharge end to maintain the flow. When the door 76 is closed, the compartment 84 essentially communicates only through the port 86 in the end plate 66 within the cavity 89 formed within the shell 12. Used nitrogen gas is drawn out through this port 86 and down through the conduit 88 by means of the recirculating fan 90 which runs constantly as the device is operating. In the processing of scrap iron, for example, this recirculation of gas is at a temperature of about −150° F once the unit reaches its continuous operating condition.

Figure 6:
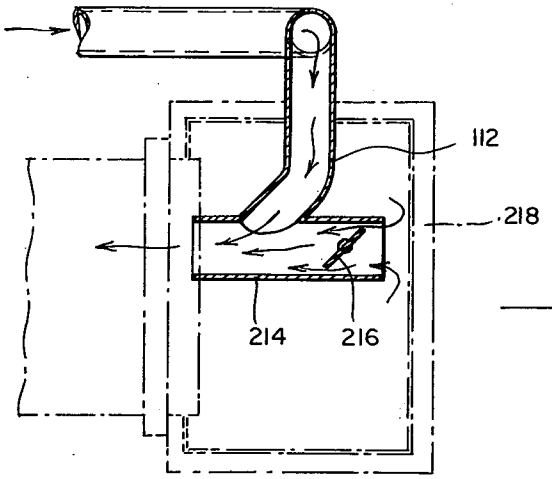
FIG. 6 is a section taken as indicated by the lines and arrows 6—6 in FIG. 5, with portions of the apparatus shown in phantom lines.

In the preferred embodiment shown in FIGS. 5 and 6, the nozzle 114 is replaced by an ejector 214 mounted on the discharge end of the conduit 112. The intake end of the injector is provided with a control damper 216. In this embodiment, the discharge header 218 embraces the discharge end of the rotating drum 10 to form a chamber for mounting the ejector 214, as clearly illustrated in the figures. The bottom of the header 218 has a plurality of trap doors 220 which are rotatably mounted to swing between the closed position shown in full lines and the open position shown in phantom lines. The doors are spring biased or counterweighted by any suitable means (not shown) to return to their closed position when not acted upon by material being discharged from the drum 10. Protective means in the form of angle irons and the like (as shown at 400; 401) are provided mounted above the hinges to prevent jamming of the hinge by material exiting from the unit. The doors open into a chute 222, which has a second pair of similarly mounted doors 224, which function in a similar fashion as shown by the solid and phantom lines. The chute 222 opens into the crusher 92. The ejector improves the operation of the system by recirculating a portion of the nitrogen which would otherwise be discharged. This portion of the nitrogen is drawn into the ejector from the discharge header 218 as shown by the arrows in FIG. 6 and is induced to flow from the discharge end of the drum toward the intake or upstream end of the drum.

The flow pattern provided by the recirculating system provides a pre-cooling chamber in the upstream portion of the drum 10 between the port 86 and that nozzle which is positioned at the upstream end of the header 100. In this pre-cooling chamber, the nitrogen gas which has lost much of its cooling power by virtue of contact with the material in the drum in the downstream freezing portion thereof, is exposed to the incoming material to reduce its temperature before it enters the freezing chamber, thereby increasing the effectiveness of the system in the freezing portion of the drum.

Since more nitrogen is constantly being introduced through the nozzles 102, there is a build-up of nitrogen gas such that the excess must, at times, be withdrawn. This is done in the recirculation cycle by means of the discharge conduit 116 connected to a valve mechanism (shown schematically at 117) which can be operated in response to an automatic flow indicator 118.

The input of nitrogen, the withdrawal of used nitrogen, and the speed of the rotation of the drum are all regulated in accordance with the actual effect on the particular items of material being processed. Thus, these can and must be adjusted depending on the thickness of the material and other factors which may be encountered in dealing with the particular material. In the case of scrap, the end result is to render some of the scrap components brittle and fragile by subjecting it to the low temperature refrigerant gas while conveying it in the rotating drum, so that by the time the scrap is discharged through the insulated free swinging door 119 down the chute 120, FIG. 1, into the crusher 92, it is ready for fragmentation by impaction or crushing. To this end, thermocouples are provided as at 300, 301, 302, 303, 304 and 305 to monitor temperature and for use in adjusting the controls.

It will be observed from what has been described that in operation this device automatically takes care of frost build-up within the drum by virtue of the wiping action of the material on the walls of the drum. The ice which is removed is then transported out of the drum with the material. This wiping action also prevents particle build-up. Furthermore, since there is no mechanism having moving parts within the freezing zone, there can be no freeze-up of the material transporting means.

It will also be observed that by re-introducing a portion of the nitrogen gas at the downstream end of the drum, there is a thorough mixing and intimate contact between the refrigerant gas and the material. This contact is enhanced by the constant motion of the material within the drum.

It will be understood that various changes in the details, materials and arrangement of parts which have been herein described and illustrated in order to explain the nature of this invention may be made by those skilled in the art within the principle and scope of the invention as expressed in the following claims. For example, the same process and apparatus can be employed for cooling other materials, such as scrap rubber, food products, plastics, organic material, metallics, and the like.

It will be further understood that the "Abstract of the Disclosure" set forth above is intended to provide a nonlegal technical statement of the contents of the disclosure in compliance with the Rules of Practice of the United States Patent Office, and is not intended to limit the scope of the invention described and claimed herein.

What is claimed is:

1. A refrigeration means, comprising:

a. a rotatable drum having means to receive and to discharge material; said drum having an interior configuration which further comprises transport means for advancing the material longitudinally within said drum upon rotation of the drum; and wherein the drum is supported for rotation on a plurality of rings, said rings having, as part thereof, insulated force-transmitting members;

b. rotation means engaging said drum for rotating said drum; and c. refrigeration means within said drum to refrigerate said material while it is within said drum.

2. The invention of claim 1 wherein each of said rings comprises a first portion attached to the exterior of said drum, a second portion engaging said rotation means and means engaging said insulating and force-transmitting member and retaining said first portion to said second portion with said member therebetween.

3. The invention of claim 1 wherein said rotation means comprises a plurality of motor driven rollers engaging said rings.

4. The invention of claim 1 wherein said motor is variable speed to thereby control the speed of rotation of said drum and the speed of advancement of material through said drum.

5. A refrigerating means, comprising:

a. a rotatable drum having means to receive and to discharge material; said drum having an interior configuration which further comprises transport means for advancing the material longitudinally within said drum upon rotation of the drum;

b. rotation means engaging said drum for rotating said drum;

c. an intake header means through which material may be introduced into said drum, juxtaposed to the material receiving end of said drum so that said drum is free to rotate with respect thereto, said intake header means forming a chamber communicating with the interior of said drum;

d. refrigeration means within said drum to refrigerate material while it is within said drum; said refrigeration means further comprising a low temperature fluid introduced within said drum; and e. recirculation means to recirculate said fluid from said chamber of said intake header means, to and through the end of said drum from which material is discharged.

6. A refrigerating means, comprising:

a. a rotatable drum having means to receive and to discharge material; said drum having an interior configuration which further comprises transport means for advancing the material longitudinally within said drum upon rotation of the drum;

b. rotation means engaging said drum for rotating said drum; and c. refrigeration means within said drum to refrigerate material while it is within said drum; said refrigeration means further comprising a low temperature fluid introduced within said drum and recirculation means to recirculate said fluid from the end of said drum which receives said material externally to and through the end of said drum from which material is discharged;

said fluid being introduced in and through said discharge end by an ejector means.

7. The invention of claim 6 wherein a discharge chamber is provided within a discharge header juxtaposed to the discharge end of said drum; said ejector means being mounted within said chamber to draw gas therefrom and to recirculate it with a gas from the other end of the drum.

8. The invention of claim 6 wherein said ejector means has a damper control in its intake.

9. The invention of claim 7 wherein said discharge header has at least one door to permit discharge of material from said header; said door being rotatably mounted to said header by a hinge means; and protective means are mounted in said header to prevent jamming of said hinge by said material.

10. The invention of claim 7 wherein said discharge header comprises a structure providing an insulated chamber communicating with the interior of the drum and having at least one door biased normally closed to automatically open to allow discharge of material from said chamber; said structure providing a second chamber for receiving material discharged from said first chamber; said second chamber having an exit door biased normally closed to automatically open to allow material to exit therefrom.

11. A refrigerating means, comprising:

a. a rotatable drum having means to receive and to discharge material; said drum having an interior configuration which will transport the material received through said drum upon rotation of said drum;

b. rotation means engaging said drum for rotating said drum;

c. refrigeration means within said drum to refrigerate said material while it is being transported through said drum; and d. an improved feeder means for introducing material into said drum, comprising: an intake header juxtaposed to the material receiving end of said drum so that said drum is free to rotate with respect thereto; said intake header forming a chamber communicating with the interior of said drum; said header having a means passing therethrough for introducing material through said chamber into said drum, and a stack means for withdrawing air and gas from said chamber.

12. The invention of claim 11 wherein said stack means comprises a stack having mounted therein a fan to withdraw air and gas from said chamber.

13. A refrigerating means comprising:

a. a rotatable drum having means to receive and to discharge material; said drum having an interior configuration which will transport the material received through said drum upon rotation of said drum;

b. rotation means engaging said drum for rotating said drum;

c. improved feeder means for introducing material into said drum comprising an intake header juxtaposed to the material receiving end of said drum so that said drum is free to rotate with respect thereto, said intake header forming a chamber communicating with the interior of said drum, said header having a means passing therethrough for introducing material through said chamber into said drum, and wherein heating means are provided between said header and said drum to prevent frost build-up therebetween; and d. refrigeration means within said drum to refrigerate said material while it is being transported through said drum.

14. The invention of claim 13 wherein insulation is provided on said drum proximate to said header and said heating means.

15. The invention of claim 14 wherein temperature sensing means are provided within the refrigerating means to control the rotation of said drum and the feeder means.

16. A refrigerating means, comprising:

a. a rotatable drum having means to receive and to discharge material; said drum having an interior configuration which further comprises transport means for advancing the material longitudinally within said drum upon rotation of the drum;

b. rotation means engaging said drum for rotating said drum;

c. refrigeration means within said drum to refrigerate said material while it is within said drum; and d. reciprocating feeder means for shaking material placed therein into said drum at a pre-selected controlled rate of introduction of material into said drum for subsequent refrigeration within said drum.

* * * * *